US005392543A

United States Patent [19]

Lehrman

[11] Patent Number: 5,392,543

[45] Date of Patent: Feb. 28, 1995

[54] IRONING BOARD COVER WITH DRAWSTRING AND TENSIONING STRAPS

[76] Inventor: David Lehrman, 207 Barclay Cir., Cheltenham, Pa. 19102

[21] Appl. No.: 180,727

[22] Filed: Jan. 13, 1994

[51] Int. Cl.[6] ..... D06F 83/00

[52] U.S. Cl. ..... 38/140

[58] Field of Search ..... 38/66, 140; 24/20 R

[56] References Cited

U.S. PATENT DOCUMENTS

| | | | |
|---|---|---|---|
| 1,420,027 | 6/1922 | Ehrman et al. | 38/140 X |
| 1,590,983 | 6/1926 | Polski | 38/140 |
| 1,634,619 | 7/1927 | Lake | 38/140 X |
| 2,210,601 | 8/1940 | Scanlon | 38/140 X |
| 2,264,644 | 12/1941 | Santangelo | 38/66 |
| 2,711,601 | 6/1955 | Lehrman | 38/140 |
| 2,999,325 | 9/1961 | Munson et al. | 38/140 |
| 4,813,166 | 3/1989 | Drake | 38/140 |
| 5,231,777 | 8/1993 | Mattesky et al. | 38/140 |

*Primary Examiner*—Clifford D. Crowder
*Assistant Examiner*—Ismael Izaguirre
*Attorney, Agent, or Firm*—Seidel, Gonda, Lavorgna & Monaco

[57] ABSTRACT

An ironing board cover assembly for covering an ironing board table has a cover having a fabric layer substantially the same shape as the surface of the ironing board table but having an area somewhat larger than that of the table so as to form a peripheral edge portion adapted to wrap around the peripheral edge of the ironing table. A drawstring is confined in a channel attached to or formed in the fabric layer peripheral edge portion. The drawstring runs the length of the peripheral edge portion. The cover has a series of openings spaced along the channel comprising at least one pair of first and second openings in the channel at opposing edge segments of the cover. The openings expose opposing segments of the drawstring. The cover assembly has an adjustable tensioning means such as a cloth tensioning strap for spanning the distance between the cover opposing edge segments when the cover is installed on an ironing board table. The strap is adapted for releasably engaging the drawstring opposing segments through the first and second openings to draw the opposing edge segments toward each other.

15 Claims, 3 Drawing Sheets

IRONING BOARD COVER WITH DRAWSTRING AND TENSIONING STRAPS

FIELD OF THE INVENTION

This invention relates to ironing board covers and more particularly to an ironing board cover having a tensioning means for keeping the cover taut when installed on an ironing board.

BACKGROUND OF THE INVENTION

In domestic ironing, the article to be ironed is placed on an ironing board, and a hand-held iron is used to condition the fabric to achieve the desired result. Typically, the ironing board has an ironing table and a pair of legs that pivot relative to each other to adjust the height of the table.

The ironing board table is typically covered with a resilient pad that also dissipates the heat. The ironing board table and the pad are typically covered by a fabric cover. The fabric cover is slightly larger than the table and the peripheral edge of the cover is wrapped around the peripheral edge of the table. A binding along the peripheral edge may contain a drawstring to gather the fabric cover, thereby securing the cover around the peripheral edge of the table. An alternative method is to have an elastic binding mounted on the peripheral edge in place of the drawstring. The elastic binding gathers the peripheral edge of the cover to secure the cover around the peripheral edge of the table. The shortcoming of these methods is that neither method effectively holds the cover taut. Furthermore, neither arrangement holds the fabric taut in the lateral direction of the ironing table, that is, the direction perpendicular to the longitudinal axis of the table.

One method of tensioning an ironing board cover in the lateral direction is to secure a binding along the cover's peripheral edge and include lacing holes randomly interspersed along the binding. A drawstring extends through the binding around the periphery of the cover in a conventional manner. Portions of the drawstring is pulled through the randomly interspersed holes in the binding to provide eyelets. A lacing string is laced through the drawstring eyelets pulled through the holes in the binding in a criss-cross fashion across the underside of the board. See U.S. Pat. No. 2,711,601. A shortcoming of this lacing method is that it is difficult to adjust the tension in specific portions of the lacing string. Moreover, the lacing string must be unlaced completely to remove the fabric cover from the board for washing or replacement. The lacing string interferes with the mechanism that allows the legs of the ironing board to fold for storage. Therefore, the lacing string must be removed to fold the legs for storage. In addition, the binding along the periphery of the cover is typically made of a lightweight material and is likely to tear.

It is desired to have an ironing board cover that can be maintained taut in the longitudinal and lateral direction, and easy to install on the ironing board table.

SUMMARY OF THE INVENTION

This invention relates to an ironing board cover assembly for covering an ironing board table, comprising a cover and tensioning means. The cover has a fabric body layer substantially the same shape as the surface of the ironing board table but having an area somewhat larger than that of the table so as to form a peripheral edge portion adapted to wrap around the peripheral edge of the ironing table. A drawstring is confined in a channel attached to or formed in the fabric layer peripheral edge portion. The drawstring runs the length of the peripheral edge portion. The cover has a series of openings spaced along the channel comprising at least one pair of first and second openings in the channel at opposing edge segments of the cover. The openings expose opposing segments of the drawstring. The tensioning means, such as a tensioning strap, spans the distance between the cover's opposing edge segments when the cover is installed on an ironing board table. The strap is adapted for releasably engaging the drawstring's opposing segments through the first and second openings to draw the opposing edge segments toward each other.

In a preferred embodiment, a binding is attached to the fabric layer peripheral edge by a pair of parallel stitching lines to form the channel in which the drawstring passes.

In a preferred embodiment, the tensioning device is a flexible strap having a loop portion at each strap end to encircle the drawstring segment. The strap length is adjustable by adjusting the size of at least one loop, thereby varying the tension applied to the opposing cover edge segments.

Further objects, features and advantages of the present invention will become more apparent to those skilled in the art as the nature of the invention is better understood from the accompanying drawings and detailed description.

BRIEF DESCRIPTION OF THE DRAWINGS

For the purpose of illustrating the invention, them is shown in the drawings a form which is presently preferred; it being understood, however, that this invention is not limited to the precise arrangements and instrumentalities shown.

DETAILED DESCRIPTION OF THE INVENTION

Figure 1:
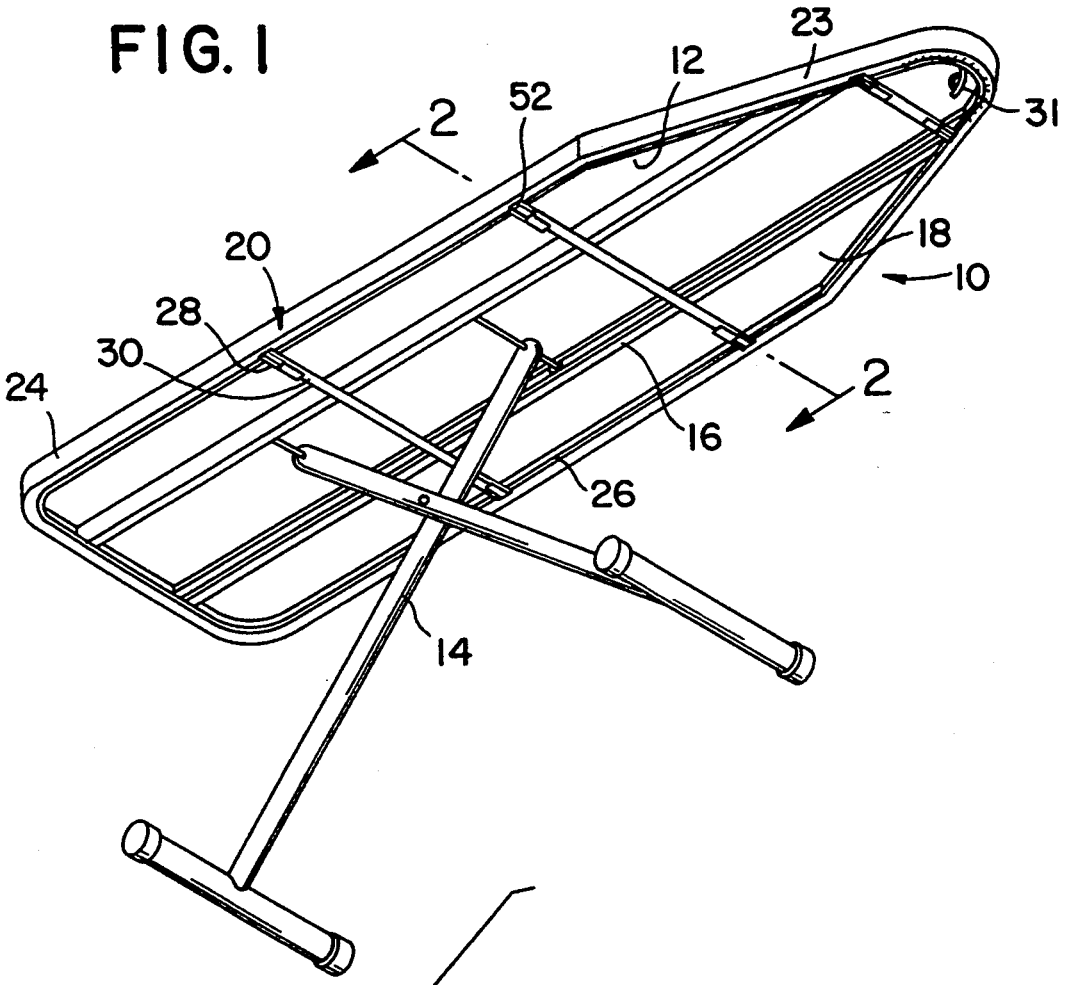
FIG. 1 is a perspective view of an ironing board shown from underneath having an ironing board cover and tensioning straps according to the present invention.

Referring to the drawings in detail, wherein like numerals indicate like elements and where primes (') indicate counterparts of such like elements, there is illustrated an ironing board cover assembly in accordance with the present invention designated generally as 20.

Referring to FIG. 1, an ironing board 10 of conventional construction has a ironing table 12 and a pair of folding legs 14. The ironing table 12 has a pair of support rails 16 which extend longitudinally on the underside 18 of the ironing table 12 from a tapered end, called the nose, to the other end, the heel end. One of the legs is pivotably mounted to the support rails 16. The other leg slides relative to the support rails 16 to raise and lower the ironing table 12.

The ironing board 10 has installed thereon the ironing board cover assembly 20 of the present invention. The ironing board cover assembly 20 has a cover 23 and a plurality of tensioning means such as flexible straps 30 or metal bars 82 of FIG. 6. The cover 23 has a fabric layer 24, a binding 26 around the peripheral edge 40 of the fabric layer 24, and a drawstring 28 interposed between the fabric layer 24 and the binding 26. The straps 30 are located so that they do not interfere with the folding legs 14 when the cover assembly 20 is installed on the ironing table 12. The fabric layer 24 has a hole, not shown, through which ends 31 of the drawstring 28 extend so that the ends 31 of the drawstring 28 may be tied together.

Figure 2:
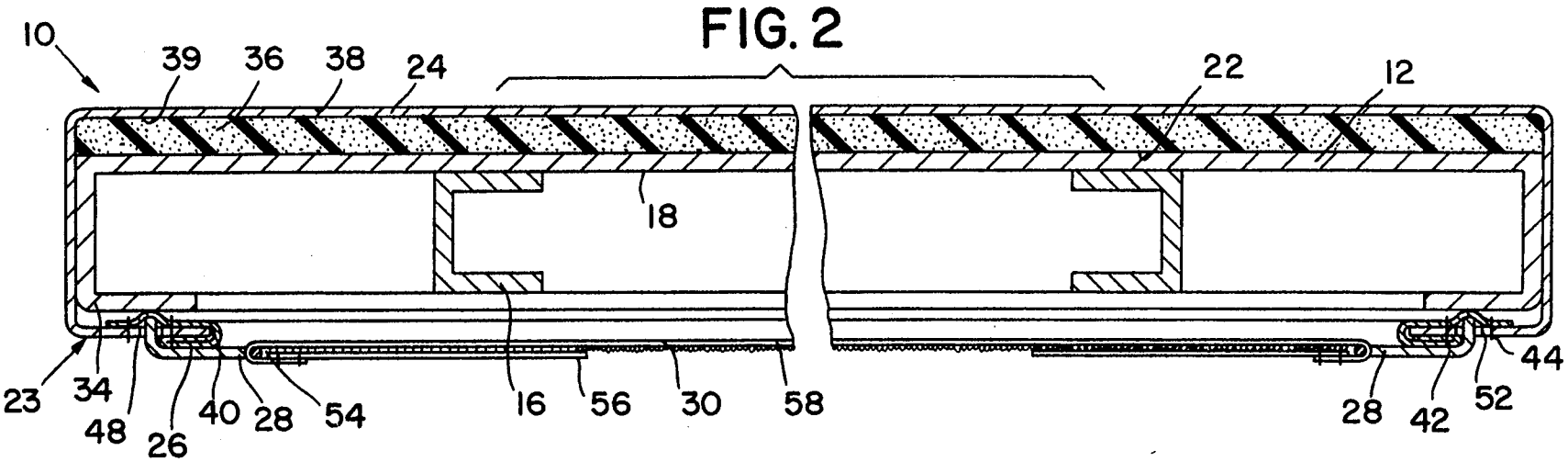
FIG. 2 is a sectional view of the ironing board taken along the line 2—2 of FIG. 1.

Referring to FIG. 2, the ironing table 12 comprises a top surface 22 supported and stiffened by the support rails 16 and a peripheral "L" shaped edge 34 that depends downward from the underside 18 of the ironing table 12. The ironing board 10 may have a pad 36 located on top of the top surface 22 of the ironing table 12 for dissipating the heat of the iron and cushioning the iron. The pad 36 is of conventional construction. The pad 36 may be attached to the underside of the fabric layer 24 of the cover 23, or may be integral therewith.

The fabric layer 24, which is slightly larger than the top surface 22 of the ironing table 12, has a top surface 38 upon which ironing is conducted and a bottom or non-appearance surface 39 which contacts the pad 36. The fabric layer 24 extends downward around the "L" shaped peripheral edge 34 of the ironing table 12 in conventional fashion. The peripheral edge 40 of the fabric layers is located in proximity to the "L" shaped peripheral edge 34 when installed on the ironing table 12.

According to a preferred embodiment, the binding 26 around the periphery of the cover 24 is a one and one-half ($1\frac{1}{2}$) inch wide tricot binding and is secured to the peripheral edge 40 of fabric layer 24 to cover the fabric layer 24. The binding 26 is folded over on one edge to give a finished appearance to the ironing board cover. The binding 26 is secured to the fabric layer 24 by parallel stitching lines 42 and 44. In the alternative, the binding 26 could be installed to the fabric layer 24 by weld lines or glues lines. The stitching lines 42 and 44 run parallel to the peripheral edge 40 of the fabric layer 24. One of the stitching lines 42 is located closest to the peripheral edge 40 of the fabric layer 24 and secures the binding 26 both on the top surface 38 and the non-appearance surface 39 of the fabric layer 24. The other stitching line 44, located farther from the peripheral edge 40, retains the binding 26 only on the non-appearance edge 39. In a preferred embodiment, the two stitching lines 42 and 44 are made using a $\frac{1}{4}$ inch gauge double needle sewing machine so that the stitching line 42 is located $\frac{1}{4}$ inch from the peripheral edge 40 of the fabric layer 24 and the stitching line 44 is located $\frac{1}{4}$ inch from the stitching line 42.

The binding 26 and the fabric layer 24, sewn together by the stitching lines 42 and 44, define a channel 48, preferably about $\frac{1}{4}$ inch wide, which receives the drawstring 28. Channel 48 with the drawstring 28 disposed therein runs along the entire peripheral edge 40 of the fabric layer 24. The fabric layer 24 has a series of openings 52 generally having the shape of buttonholes. The openings 52 provide access to the channel 44 and the drawstring 28 confined therein. The openings 52 in the fabric layer 24 are positioned along the channel 48 in pairs. The openings 52 of each pair are positioned substantially lateral across from each other when the cover 23 is placed on the ironing table 12. Thus, a tensioning means described more fully below, when applied across the two openings, will lie substantially perpendicular to the table surface's longitudinal axis. FIG. 1 shows three pairs of openings 52 spaced 13 to 18 inches apart. Each of the pairs of openings 52 is positioned so as not to interfere with the movement of folding legs 14, when the tensioning means are connected. Therefore, the legs 14 may be folded to allow storage of the ironing board 10 without removing the cover assembly 20 from the ironing table.

Figure 3:
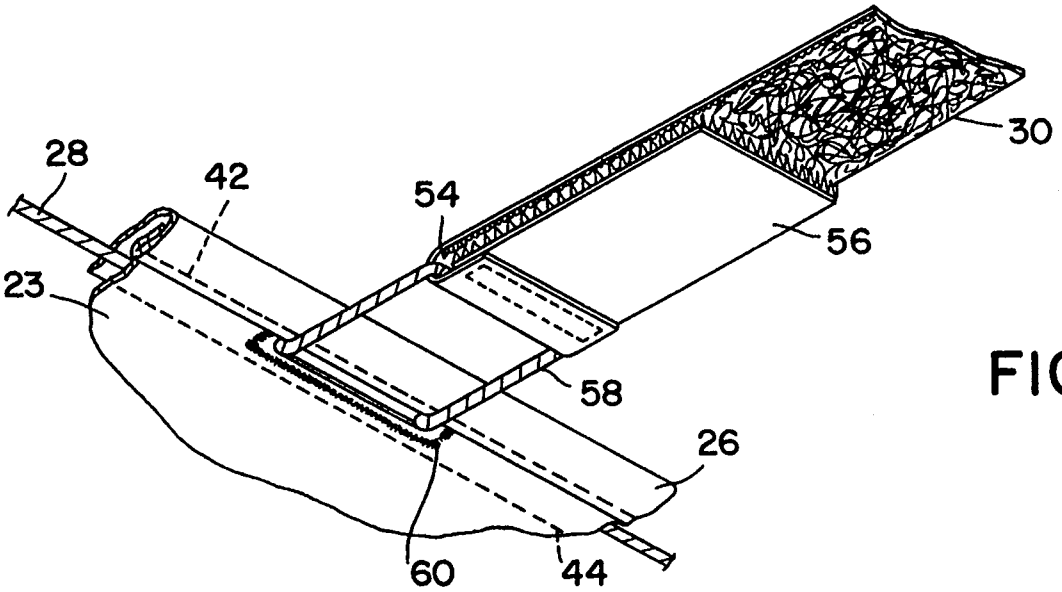
FIG. 3 is a broken-out section from a top surface of an ironing board fabric and binding with a drawstring extending through an opening in the fabric and pulled taut by the strap.

The ironing board cover assembly 20 includes one or more tensioning means such as in the form of straps 30. The straps 30 are preferably formed of a flexible material such as cloth. The straps 30 are sized so as to span the lateral distance between opposing openings 52 when the cover 23 is placed on the ironing table 12. One end of strap 30 is threaded between the drawstring 28 and the fabric layer 24, and doubled back to form a loop 54. Loop 54 is formed by end segment 56 of strap 30 engaging a middle portion 58 of the strap 30 as shown in FIG. 3. The strap 30 may include a hook and loop fastener, such as sold under the trademark VELCRO®, to secure the end segments 56 of the strap 30 to the strap middle portion 58, thereby forming the loop. A series of snaps or buckles could likewise be used to secure the end segment 56 to the middle portion 58 of the strap 30. The drawstring 28 which is accessible through the opening 52 in the fabric layer 24 is thus encircled by the loop 54 when the strap is installed. The loop 54 at each end of the strap 30 engages opposing segments of the drawstring 28 thereby pulling opposing edges of the fabric layer 24 laterally towards each other. This exerts a lateral tension across the fabric layer 24.

Referring to FIG. 3, a broken-out section view from the top surface 38 of the fabric layer 24 is shown. Tension on drawstring 28 causes it to extend through the opening 52 from the channel 44 defined by the binding 26 and the fabric layer 24. The length of strap 30, and therefore the lateral degree of tension exerted across the ironing board cover, is adjusted by adjusting the size of loop 54. The openings 52 are reinforced by a stitching 60.

Figure 4:
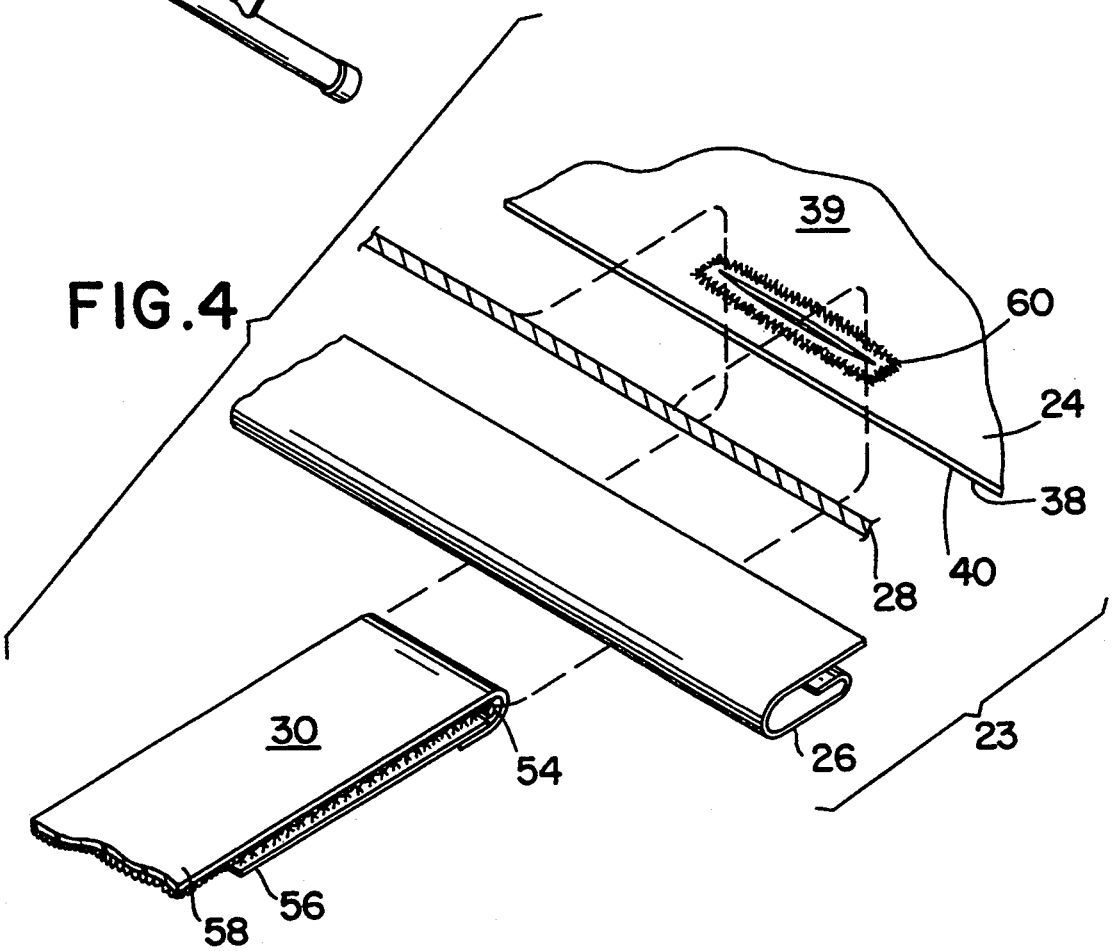
FIG. 4 is an exploded view from a non-appearance surface of the broken-out section shown in FIG. 3.

Referring to FIG. 4, the binding 26 is adapted to cover the peripheral edge 40 of the fabric layer 24. Binding 26 has a portion which is folded over to give a finished look to the fabric layer's top surface 38. The drawstring 28 is accessible to the top surface 38 of the fabric layer 24 through the opening 52.

The ironing board cover 23 is installed on the ironing table 12 by loosening the drawstring 28 and stretching the cover over the ironing table and the drawstring is pulled taut and tied off in the conventional manner. The ends of straps 30 are threaded through the appropriate openings 52. As shown in FIG. 1, the tensioning straps 30 extend perpendicular to the longitudinal axis of the ironing table 12. The tensioning straps 30 are also perpendicular to the drawstring 28 and the channel 48, except for the strap 30 in the nose portion of the ironing table 12. The tensioning straps 30 by engaging the drawstring 28, instead of the fabric layer 24, create a uniform total tension on the cover 23. The iron board cover assembly 20 is easily removable for washing or replacement.

Figure 5:
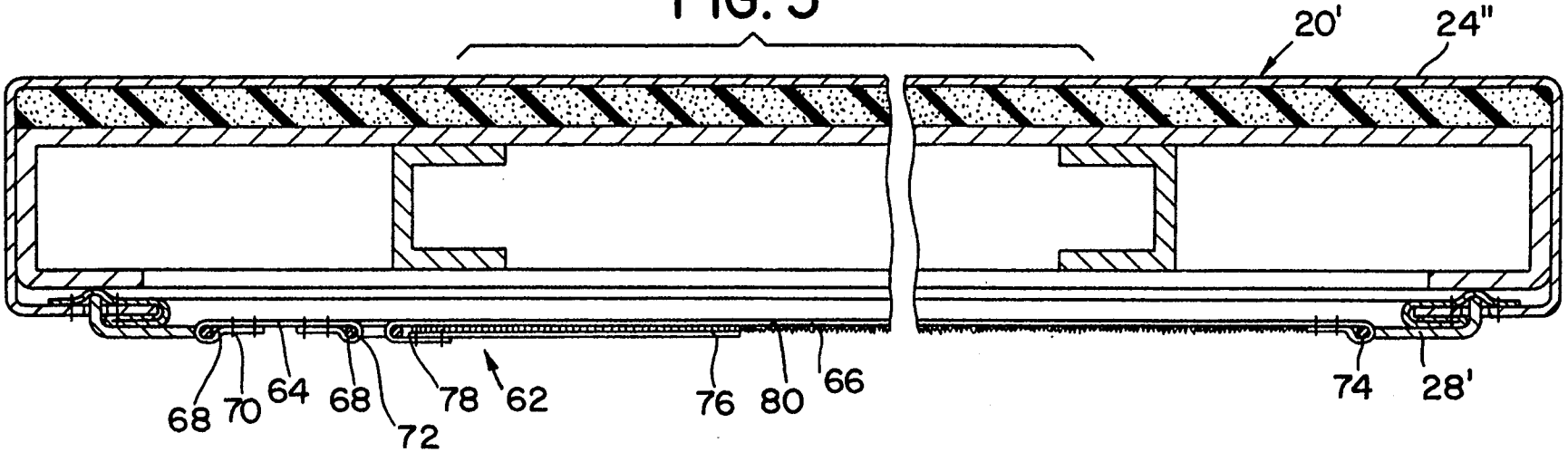
FIG. 5 is a sectional view similar to FIG. 2 showing an alternative embodiment.

An alternative embodiment is shown in FIG. 5 where the cover assembly 20' includes a flexible tensioning strap 62. The strap 62 has a pair of cloth tapes 64 and 66. The cloth tape 64 has a pair of loops 68. The loops 68 are defined by ends segments of the tape 64 engaging a middle portion. The end segments are secured to the middle portion by a series of stitches 70. One of the loops 68 receives the drawstring 28' from one of the openings 52'. The other loop 68 receives a metal "D" ring 72. The cloth tape 66 has a loop 74, similar in construction to the loops 68, which receives the drawstring 28' from the other opening 52'. The cloth tape 66 has another end 76 which defines a loop 78 by the end segment 76 of the cloth tape 66 engaging a middle portion 80 of the cloth tape 66. The cloth tape 66 has a hook and loop fastener similar to the first embodiment. The loop 78 receives the metal ring 72 for pulling the drawstrings 28' from each opening 52' laterally towards each other thereby pulling the fabric layer 24' taut in the lateral direction by pulling opposing edges towards each other.

Figure 6:
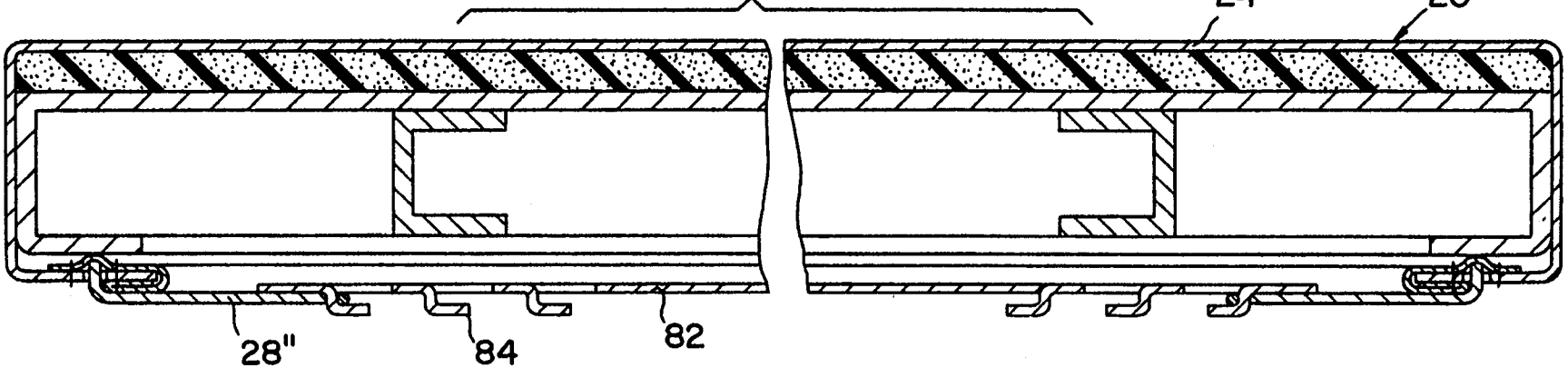
FIG. 6 is a sectional view similar to FIG. 2 showing a second alternative embodiment.

A second alternative embodiment is shown in FIG. 6 where the cover assembly 20'' includes a rigid, e.g., metal or rigid plastic, tensioning bars 82 having a plurality of "L" shaped hooks 84. The "L" shaped hooks 84 are clustered in two sets, one set located near each bar end. The legs of the hooks 84 point inward toward the strap middle portion, the hooks 84 in both for selectably engaging opposing segments of the drawstring 28''. In operation, each of the two opposing drawstring segments are pulled through the respective opening 52'' and hooked around one of the "L" shaped hooks 84, thereby pulling the fabric layer 24'' taut in a direction perpendicular to the longitudinal axis of the ironing board cover.

The present invention may be embodied in other specific forms without departing from the spirit or essential attributes thereof and, accordingly, reference should be made to the appended claims, rather than to the foregoing specification, as indicating the scope of the invention. For example, grommets or die-cut holes can replace the openings.

I claim:

1. An ironing board cover assembly for covering an ironing board table, the table having an ironing surface bounded by a peripheral edge, the assembly comprising:

a fabric layer substantially the same shape as the ironing surface of the ironing board table but having an area somewhat larger than the ironing surface of the table so as to form a peripheral edge portion adapted to wrap around the peripheral edge of the ironing table;

a drawstring confined in a channel, the channel formed by a binding attached to said cover peripheral edge portion by a pair of parallel stitching lines, said drawstring passes between the binding and the fabric layer in the channel, running the length of said peripheral edge portion;

a series of openings in the fabric layer spaced along said channel comprising at least one pair of first and second openings in said channel at opposing edge segments of the cover, said openings exposing segments of said drawstring; and tensioning means for adjustably spanning the distance between said cover opposing edge segments when the cover is installed on an ironing board table, said tensioning means adjustably and releasably engaging said drawstring segments through said first and second openings to draw the opposing cover edge segments toward each other.

2. An ironing board cover assembly according to claim 1 wherein the tensioning means comprises a flexible strap defining a strap length having end segments containing means for releasably engaging the drawstring opposing segments.

3. An ironing board cover assembly according to claim 2 wherein the means on said strap end segments for releasably engaging the drawstring segment comprises a loop portion releasably formed on said end segment to encircle the drawstring segment, said strap length being adjustable by adjusting the size of at least one loop, thereby varying the tension applied to the opposing cover edge segments.

4. An ironing board assembly according to claim 3 wherein the strap loop is releasably formed by mating hook and loop segments on said strap.

5. An ironing board cover assembly according to claim 1, wherein the tensioning means comprises a pair of flexible straps, one of the straps having a loop encircling the drawstring at one of the holes and a ring, the other strap having a loop encircling the drawstring at the other hole and an adjustable loop for releasably engaging the ring.

6. An ironing board cover assembly according to claim 1 wherein the tensioning means comprises a bar having a plurality of hooks disposed at each end thereof for selectably engaging the drawstring opposing segments.

7. An ironing board cover assembly for covering an ironing board table, the table having a longitudinal axis and having an ironing surface bounded by a peripheral edge, the assembly comprising:

a fabric body substantially the same shape as the ironing surface of the ironing board table but having an area somewhat larger than the ironing surface of the table so as to form a peripheral edge portion adapted to wrap around the peripheral edge of the ironing table;

a drawstring confined in a channel, the channel formed by a binding attached to said cover peripheral edge portion by a pair of parallel stitching lines, said drawstring passing between the binding and the fabric layer in the channel, running the length of said peripheral edge portion;

a series of openings in the fabric layer spaced along said channel comprising at least one pair of first and second openings in said channel at opposing edge segments of the cover, said openings exposing opposing segments of said drawstring; and at least one flexible strap having an adjustable length sized for spanning the distance between said drawstring opposing segments when the cover is installed on an ironing board table, the strap being adapted for adjustably and releasably engaging said drawstring opposing segments through said first and second openings to draw the opposing drawstring segments toward each other, said first and second openings in the channel being located such that the strap is disposed essentially perpendicular to the longitudinal axis of said table.

8. An ironing board cover assembly according to claim 7 wherein the flexible strap has a specific strap length and having end segments for releasably engaging the drawstring segment comprises a loop portion releasably formed on said end segment to encircle the drawstring segment, said strap length being adjustable by adjusting the size of at least one loop, thereby varying the tension applied to the opposing cover edge segments.

9. An ironing board assembly according to claim 8 wherein the strap loop is releasably formed by mating snaps on said strap.

10. An ironing board assembly according to claim 8 wherein the strap loop is releasably formed by mating hook and loop segments on said strap.

11. An ironing board cover assembly according to claim 7, wherein at least one strap comprises a pair of flexible straps, one of the straps having a loop at one end encircling the drawstring at one of the openings and a ring at the other end, the other strap having a loop at one end encircling the drawstring at the other opening and an adjustable loop at the other end for releasably engaging the ring.

12. An ironing board cover assembly for covering an ironing board table, the table having a longitudinal axis and having an ironing surface defining an area bounded by a peripheral edge, the assembly comprising:

a fabric body substantially the same shape as the ironing surface of the ironing board table but having an area somewhat larger than the area of the ironing surface of the table so as to form a peripheral edge portion of a specific length, the peripheral edge portion adapted to wrap around the peripheral edge of the ironing table defining a pair of opposing edge segments;

a drawstring confined in a channel, the channel formed by a binding attached to said cover peripheral edge portion by a pair of parallel stitching lines, said drawstring passing between the binding and the fabric layer in the channel running the length of said peripheral edge portion;

a series of openings spaced along said channel comprising at least one pair of first and second openings in said channel in the fabric layer in the opposing edge segments of the cover, said openings each exposing a segment of said drawstring; and at least one bar sized for spanning the distance between said drawstring opposing segments when the cover is installed on an ironing board table, the bar having a plurality of hooks disposed at each end thereof for selectably engaging the opposing drawstring segments through said first and second openings to draw the opposing drawstring segments toward each other, said first and second openings in the channel being located such that the bar is disposed essentially perpendicular to the longitudinal axis of said table.

13. An ironing board cover assembly according to claim 7 wherein the ironing board has a pair of ironing board legs pivotable mounted to each other and at least one of the legs slideably mounted to the table, the series of openings in the fabric layer are located so that the flexible straps extending between the opposed drawstring segments are located relative to the pair of ironing board legs so as to allow movement of the legs without interference from the straps.

14. An ironing board cover assembly for covering an ironing board table, the table having an ironing surface defining an area bounded by a peripheral edge, the assembly comprising:

a fabric body substantially the same shape as the ironing surface of an ironing board table but having an area somewhat larger than the area of the ironing surface of the table so as to form a peripheral edge portion of a specific length, the peripheral edge portion adapted to wrap around the peripheral edge of the ironing table defining a pair of opposing edge segments;

a drawstring confined in a channel, the channel formed by a binding attached to the cover peripheral edge by a pair of parallel stitching lines, said drawstring passing between the binding and the fabric layer in the channel, the drawstring running the length of said peripheral edge portion;

a series of openings in the fabric spaced along said channel comprising at least one pair of first and second openings in said channel being located directly across from each other on the opposing edge segments of the cover, said openings each exposing a segment of said drawstring for engagement by tensioning means to draw the opposing edge segments toward each other.

15. An ironing board cover assembly for covering an ironing board table, the table having a longitudinal axis and having an ironing surface bounded by a peripheral edge, the assembly comprising:

a fabric body substantially the same shape as the ironing surface of the ironing board table but having an area somewhat larger than the ironing surface of the table so as to form a peripheral edge portion adapted to wrap around the peripheral edge of the ironing table;

a drawstring confined in a channel carried by the cover peripheral edge portion, the drawstring running the length of said peripheral edge portion;

a series of openings in the fabric layer spaced along said channel comprising at least one pair of first and second openings in said channel at opposing edge segments of the cover, said openings exposing opposing segments of said drawstring; and a plurality of flexible straps, at least one strap having an adjustable length sized for spanning the distance between said drawstring opposing segments when the cover is installed on an ironing board table, the flexible strap being adapted for adjustably and releasably engaging said drawstring opposing segments through said first and second openings to draw the opposing drawstring segments toward each other, said first and second openings in the channel being located such that the flexible strap is disposed essentially perpendicular to the longitudinal axis of said table.

* * * * *